US009234254B2

(12) United States Patent
Eguchi et al.

(10) Patent No.: US 9,234,254 B2
(45) Date of Patent: Jan. 12, 2016

(54) HIGH-STRENGTH SEAMLESS STEEL TUBE, HAVING EXCELLENT RESISTANCE TO SULFIDE STRESS CRACKING, FOR OIL WELLS AND METHOD FOR MANUFACTURING THE SAME

(75) Inventors: Kenichiro Eguchi, Aichi (JP); Yuji Tanaka, Kanagawa (JP); Mitsuo Kimura, Chiba (JP); Yasuhide Ishiguro, Aichi (JP); Katsumi Yamada, Kanagawa (JP); Haruo Nakamichi, Okayama (JP)

(73) Assignee: JFE Steel Corporation (JP)

( * ) Notice: Subject to any disclaimer, the term of this patent is extended or adjusted under 35 U.S.C. 154(b) by 585 days.

(21) Appl. No.: 13/379,723

(22) PCT Filed: Jun. 23, 2010

(86) PCT No.: PCT/JP2010/061093

§ 371 (c)(1),
(2), (4) Date: Apr. 9, 2012

(87) PCT Pub. No.: WO2010/150915

PCT Pub. Date: Dec. 29, 2010

(65) Prior Publication Data

US 2012/0186704 A1 Jul. 26, 2012

(30) Foreign Application Priority Data

Jun. 24, 2009 (JP) ..... 2009-150255
Apr. 30, 2010 (JP) ..... 2010-104827

(51) Int. Cl.

| | |
|---|---|
| ***C22C 38/22*** | (2006.01) |
| ***C22C 38/20*** | (2006.01) |
| ***C22C 38/24*** | (2006.01) |

(Continued)

(52) U.S. Cl.

CPC ..... *C21D 9/14* (2013.01); *C22C 38/001* (2013.01); *C22C 38/002* (2013.01); *C22C 38/02* (2013.01); *C22C 38/04* (2013.01); *C22C 38/06* (2013.01); *C22C 38/22* (2013.01); *C22C 38/24* (2013.01); *C22C 38/26* (2013.01); *C22C 38/28* (2013.01); *C22C 38/32* (2013.01); *C21D 2211/004* (2013.01); *C21D 2211/008* (2013.01)

(58) Field of Classification Search

None

See application file for complete search history.

(56) References Cited

FOREIGN PATENT DOCUMENTS

| | | |
|---|---|---|
| JP | 59-096216 A | 6/1984 |
| JP | 59-040220 B | 9/1984 |

(Continued)

OTHER PUBLICATIONS

Nakashima et al., "Estimation of Dislocation Density by X-ray Diffraction Method," *CAMP-ISU*, 2004, vol. 17, pp. 396-399 and 1 sheet of English translation of Preface.

(Continued)

*Primary Examiner* — Deborah Yee

(74) *Attorney, Agent, or Firm* — DLA Piper LLP (US)

(57) ABSTRACT

A seamless steel tube contains 0.15% to 0.50% C, 0.1% to 1.0% Si, 0.3% to 1.0% Mn, 0.015% or less P, 0.005% or less S, 0.01% to 0.1% Al, 0.01% or less N, 0.1% to 1.7% Cr, 0.4% to 1.1% Mo, 0.01% to 0.12% V, 0.01% to 0.08% Nb, and 0.0005% to 0.003% B or further contains 0.03% to 1.0% Cu on a mass basis and has a microstructure which has a composition containing 0.40% or more solute Mo and a tempered martensite phase that is a main phase and which contains prior-austenite grains with a grain size number of 8.5 or more and 0.06% by mass or more of a dispersed $M_2C$-type precipitate with substantially a particulate shape.

10 Claims, 1 Drawing Sheet

(51) Int. Cl.

| | |
|---|---|
| ***C22C 38/26*** | (2006.01) |
| ***C21D 8/10*** | (2006.01) |
| ***C21D 9/14*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/28*** | (2006.01) |
| ***C22C 38/32*** | (2006.01) |

(56) References Cited

FOREIGN PATENT DOCUMENTS

| | | | |
|---|---|---|---|
| JP | 59-232220 | A | 12/1984 |
| JP | 6-116635 | A | 4/1994 |
| JP | 06-116635 | A | 4/1994 |
| JP | 6-220536 | A | 8/1994 |
| JP | 6-235045 | A | 8/1994 |
| JP | 07-197125 | A | 8/1995 |
| JP | 7-197125 | A | 8/1995 |
| JP | 09-025518 | A | 1/1997 |
| JP | 09-067624 | A | 3/1997 |
| JP | 2000-178682 | A | 6/2000 |
| JP | 2000-297344 | A | 10/2000 |
| JP | 2001-073086 | A | 3/2001 |
| JP | 2001-172739 | A | 6/2001 |
| JP | 2002-060893 | A | 2/2002 |
| JP | 2003-041341 | A | 2/2003 |
| JP | 2003-160838 | A | 6/2003 |
| JP | 2007-016291 | A | 1/2007 |
| WO | 2005/073421 | A1 | 8/2005 |

OTHER PUBLICATIONS

Williamson, G.K. et al., "X-Ray Line Broadening from Filed Aluminum and Wolfram," *ACTA Metallurgica*, Jan. 1953, vol. 1, pp. 22-31.

HIGH-STRENGTH SEAMLESS STEEL TUBE, HAVING EXCELLENT RESISTANCE TO SULFIDE STRESS CRACKING, FOR OIL WELLS AND METHOD FOR MANUFACTURING THE SAME

RELATED APPLICATIONS

This is a §371 of International Application No. PCT/JP2010/061093, with an international filing date of Jun. 23, 2010, which is based on Japanese Patent Application Nos. 2009-150255, filed Jun. 24, 2009, and 2010-104827, filed Apr. 30, 2010, the subject matter of which is incorporated by reference.

TECHNICAL FIELD

This disclosure relates to a high-strength seamless steel tube suitable for oil wells and particularly relates to an improvement in resistance to sulfide stress cracking (hereinafter referred to as "SSC resistance") in so-called "sour" environments containing hydrogen sulfide. The term "high strength" as used herein refers to 110-ksi class strength, that is, a yield strength of 758 MPa or more and preferably a yield strength of 861 MPa or less.

BACKGROUND

In recent years, the following fields have been extensively developed because of soaring crude oil prices and the depletion of oil resources that may occur in the near future: deep oil fields that have not attracted much attention; oil fields in severe corrosion environments such as sour environments containing hydrogen sulfide and the like; and gas fields in such severe corrosion environments. Oil country tubular goods (OCTGs) used in such environments need to have properties such as high strength and excellent corrosion resistance (sour resistance).

To cope with such requirements, for example, Japanese Unexamined Patent Application Publication No. 2007-16291 discloses a low-alloy steel, having excellent resistance to sulfide stress cracking (SSC resistance), for oil well tubes. The low-alloy steel contains 0.20% to 0.35% C, 0.05% to 0.5% Si, 0.05% to 0.6% Mn, 0.8% to 3.0% Mo, 0.05% to 0.25% V, and 0.0001% to 0.005% B on a mass basis and is adjusted such that the inequality $12V+1-Mo\geq 0$ holds. In a technique disclosed in JP '291, when Cr is further contained therein, the contents of Mn and Mo are preferably adjusted depending on the content of Cr such that the inequality $Mo-(Mn+Cr)\geq 0$ is satisfied. This allows resistance to sulfide stress cracking (SSC resistance) to be enhanced.

Apart from seamless steel tubes, Japanese Unexamined Patent Application Publication No. 06-235045 discloses an electric resistance welded steel pipe which has excellent resistance to sulfide stress corrosion cracking and which contains 0.05% to 0.35% C, 0.02% to 0.50% Si, 0.30% to 2.00% Mn, 0.0005% to 0.0080% Ca, 0.005% to 0.100% Al, and one or more of 0.1% to 2.0% Mo, 0.01% to 0.15% Nb, 0.05% to 0.30% V, 0.001% to 0.050% Ti, and 0.0003% to 0.0040% B on a mass basis. The contents of S, O, and Ca therein satisfy the inequality $1.0\leq(\%\ Ca)\{1-72(\%\ O)\}/1.25(\%\ S)\leq 2.5$ and the contents of Ca and O therein satisfy the inequality $(\%\ Ca)/(\%\ O)\leq 0.55$. In a technique disclosed in JP '045, since the addition of Ca leads to an improvement in sour resistance, the content of Ca is adjusted to satisfy the inequality $(\%\ Ca)/(\%\ O)\leq 0.55$, whereby the molecular ratio of $(CaO)_m.(Al_2O_3)_n$, which is a deoxidation product, can be controlled to satisfy the inequality $m/n<1$; the stretching of complex inclusions in an electrically welded portion is avoided; the production of plate-like inclusions is prevented; and deterioration of SSC resistance due to hydrogen induced blister cracking originating from such plate-like inclusions can be prevented.

Japanese Unexamined Patent Application Publication No. 2000-297344 discloses an oil well steel which has excellent toughness and resistance to sulfide stress corrosion cracking and which is made of a low-alloy steel containing 0.15% to 0.3% C, 0.2% to 1.5% Cr, 0.1% to 1% Mo, 0.05% to 0.3% V, and 0.003% to 0.1% Nb on a mass basis. The sum of the contents of precipitated carbides is 1.5% to 4%. The percentage of the content of an MC-type carbide in the sum of the carbide contents is 5% to 45% and the content of a $M_{23}C_6$-type carbide therein is (200/t) % or less (t (mm) is the thickness of a product). The oil well steel can be produced by performing quenching and tempering at least twice.

Japanese Unexamined Patent Application Publication No. 2000-178682 discloses an oil well steel which has excellent resistance to sulfide stress corrosion cracking and which is made of a low-alloy steel containing 0.2% to 0.35% C, 0.2% to 0.7% Cr, 0.1% to 0.5% Mo, and 0.1% to 0.3% V on a mass basis. The sum of the contents of precipitated carbides is 2% to 5%. The percentage of the content of an MC-type carbide in the sum of the carbide contents is 8% to 40%. The oil well steel can be produced by performing quenching and tempering only.

Japanese Unexamined Patent Application Publication No. 2001-172739 discloses an oil well steel pipe which has excellent resistance to sulfide stress corrosion cracking and which contains 0.15% to 0.30% C, 0.1% to 1.5% Cr, 0.1% to 1.0% Mo, Ca, O (oxygen), and one or more of 0.05% or less Nb, 0.05% or less Zr, and 0.30% or less V, the sum of the contents of Ca and O being 0.008% or less, on a mass basis. Inclusions in steel have a maximum length of 80 μm or less. The number of inclusions with a size of 20 μm or less is 10 or less per 100 $mm^2$. Such an oil well steel pipe can be produced by performing direct quenching and tempering only.

Factors affecting SSC resistance are extremely complicated and therefore conditions for allowing 110-ksi class high-strength steel pipes to stably ensure SSC resistance have not been clear. At present, OCTG (Oil Coutry Tubular Goods) which can be used as oil well pipes in severe corrosion environments and which have excellent SSC resistance cannot be manufactured by any of techniques disclosed in JP '291, JP '344, JP '682 and JP '739. A technique disclosed in JP '045 relates to an electric resistance welded steel pipe in which the corrosion resistance of an electrically welded portion may possibly be problematic in a severe corrosion environment. The steel pipe disclosed in JP '045 is problematic as an oil well pipe used in a severe corrosion environment.

It could therefore be helpful to provide a high-strength seamless steel tube with excellent resistance to sulfide stress cracking (SSC resistance). The term "excellent resistance to sulfide stress cracking (SSC resistance)" means that in the case of performing constant load testing in an aqueous solution (a test temperature of 24° C.), saturated with $H_2S$, containing 0.5% by weight of acetic acid ($CH_3COOH$) and 5.0% by weight of sodium chloride in accordance with regulations specified in NACE TM 0177 Method A, cracking does not occur at an applied stress equal to 85% of the yield strength for a test duration of more than 720 hours.

SUMMARY

We discovered that to cause a seamless steel tube for oil wells to have desired high strength and excellent resistance to sulfide stress cracking, the content of Mo therein is reduced to about 1.1% or less and appropriate amounts of Cr, V, Nb, and B are essentially contained therein. We also discovered that desired high strength can be stably achieved and desired high strength and excellent resistance to sulfide stress cracking can be combined such that (1) a predetermined amount or more of solute Mo is ensured, (2) prior-austenite grain sizes are reduced to a predetermined value or less, and (3) a predetermined amount or more of an $M_2C$-type precipitate with substantially a particulate shape is dispersed. Furthermore, we discovered that to achieve increased resistance to sulfide stress cracking, (4) it is important that concentrated Mo is present on prior-austenite grain boundaries at a width of 1 nm to less than 2 nm.

We further discovered that in consideration of the fact that dislocations act as trap sites for hydrogen, the resistance to sulfide stress cracking of a steel pipe is significantly enhanced such that (5) the dislocation density of a microstructure is adjusted to $6.0\times10^{14}/m^2$ or less. We found that dislocations can be stably reduced to the above dislocation density such that the tempering temperature and soaking time in a tempering treatment are adjusted to satisfy a relational expression based on the diffusion distance of iron.

We thus provide:

(1) A seamless steel tube for oil wells contains 0.15% to 0.50% C, 0.1% to 1.0% Si, 0.3% to 1.0% Mn, 0.015% or less P, 0.005% or less S, 0.01% to 0.1% Al, 0.01% or less N, 0.1% to 1.7% Cr, 0.4% to 1.1% Mo, 0.01% to 0.12% V, 0.01% to 0.08% Nb, and 0.0005% to 0.003% B on a mass basis, the remainder being Fe and unavoidable impurities, and has a microstructure which has a tempered martensite phase is a main phase and prior-austenite grain size number is 8.5 or more and 0.06% by mass or more of a dispersed $M_2C$-type precipitate with substantially a particulate shape. The content of solute Mo is 0.40% or more on a mass basis.

(2) The seamless steel tube specified in Item (1) further contains 0.03% to 1.0% Cu on a mass basis in addition to the composition.

(3) In the seamless steel tube specified in Item (1) or (2), the microstructure further has Mo-concentrated regions which are located at boundaries between the prior-austenite grains and which have a width of 1 nm to less than 2 nm.

(4) In the seamless steel tube specified in any one of Items (1) to (3), the content $\alpha$ of solute Mo and the content $\beta$ of the $M_2C$-type precipitate satisfy the following inequality:

$$0.7\leq\alpha+3\beta\leq1.2 \quad (1)$$

where $\alpha$ is the content (mass percent) of solute Mo and $\beta$ is the content (mass percent) of the $M_2C$-type precipitate.

(5) In the seamless steel tube specified in any one of Items (1) to (4), the microstructure has a dislocation density of $6.0\times10^{14}/m^2$ or less.

(6) The seamless steel tube specified in any one of Items (1) to (5) further contains 1.0% or less Ni on a mass basis in addition to the composition.

(7) The seamless steel tube specified in any one of Items (1) to (6) further contains one or both of 0.03% or less Ti and 2.0% or less W on a mass basis in addition to the composition.

(8) The seamless steel tube specified in any one of Items (1) to (7) further contains 0.001% to 0.005% Ca on a mass basis in addition to the composition.

(9) A method for manufacturing a seamless steel tube for oil wells includes reheating a steel tube material containing 0.15% to 0.50% C, 0.1% to 1.0% Si, 0.3% to 1.0% Mn, 0.015% or less P, 0.005% or less S, 0.01% to 0.1% Al, 0.01% or less N, 0.1% to 1.7% Cr, 0.4% to 1.1% Mo, 0.01% to 0.12% V, 0.01% to 0.08% Nb, and 0.0005% to 0.003% B on a mass basis, the remainder being Fe and unavoidable impurities, to a temperature of 1000° C. to 1350° C.; hot-rolled the steel tube material into a seamless steel tube with a predetermined shape; cooling the seamless steel tube to room temperature at a rate not less than that obtained by air cooling; and tempering the seamless steel tube at a temperature of 665° C. to 740° C.

(10) In the seamless steel tube-manufacturing method specified in Item (9), quenching treatment including reheating and rapid cooling is performed prior to the tempering treatment.

(11) In the seamless steel tube-manufacturing method specified in Item (10), the tempering temperature of the tempering treatment ranges from the $Ac_3$ transformation temperature to 1050° C.

(12) The seamless steel tube-manufacturing method specified in any one of Items (9) to (11) further contains 0.03% to 1.0% Cu on a mass basis in addition to the composition.

(13) In the seamless steel tube-manufacturing method specified in any one of Items (9) to (12), the tempering treatment is performed in such a manner that the tempering temperature T (° C.) is within the above-mentioned temperature range and the relationship between the tempering temperature T ranging from 665° C. to 740° C. and the soaking time t (minutes) satisfies the following inequality:

$$70\text{ nm}\leq10000000\sqrt{(60Dt)}\leq150\text{ nm} \quad (2)$$

where T is the tempering temperature (° C.), t is the soaking time (minutes), and D ($cm^2/s$) $=4.8\exp(-(63\times4184)/(8.31(273+T))$.

(14) The seamless steel tube-manufacturing method specified in any one of Items (9) to (13) further contains 1.0% or less Ni on a mass basis in addition to the composition.

(15) The seamless steel tube-manufacturing method specified in any one of Items (9) to (14) further contains one or both of 0.03% or less Ti and 2.0% or less W on a mass basis in addition to the composition.

(16) The seamless steel tube-manufacturing method specified in any one of Items (9) to (15) further contains 0.001% to 0.005% Ca on a mass basis in addition to the composition.

The following tube can be readily manufactured at low cost and therefore great industrial advantages are achieved: a high-strength seamless steel tube exhibiting a high strength of about 110 ksi and excellent resistance to sulfide stress cracking in a severe corrosive environment containing hydrogen sulfide. In particular, when the content of Cu is within the range of 0.03% to 1.0% as specified herein, such an unpredictable particular advantage that rupture does not occur at an applied stress equal to 95% of the yield strength in severe corrosive environments is obtained.

DETAILED DESCRIPTION

Figure 1:
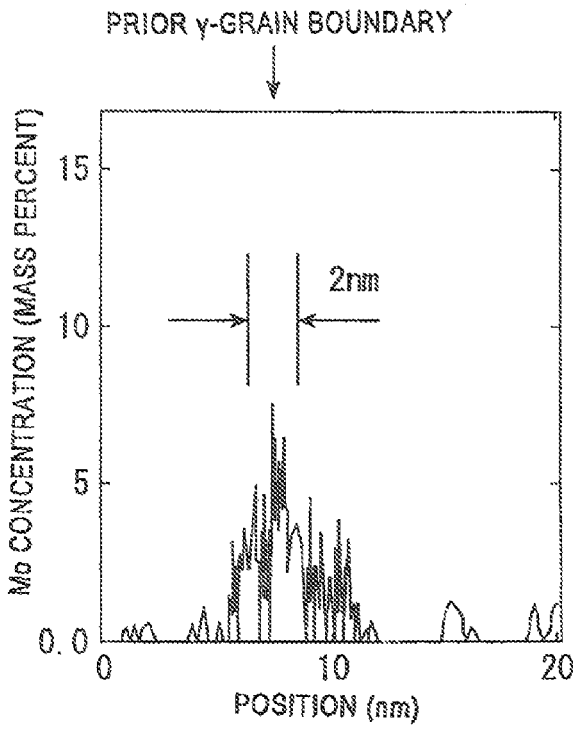
FIG. 1 is a graph showing an example of a state in which Mo is concentrated at a prior-$\gamma$ grain boundary, as a result of line analysis.

Reasons for limiting the composition of a steel tube will now be described. Unless otherwise specified, mass percent is hereinafter simply referred to as %.

C: 0.15% to 0.50%

C is an element which has the action of enhancing the strength of steel and which is important in ensuring desired high strength. Furthermore, C is an element enhancing hardenability to contribute to the formation of a microstructure in which a tempered martensite phase is a main phase. The content thereof needs to be 0.15% or more to achieve such effects. However, when the content thereof is more than 0.50%, large amounts of carbides acting as trap sites for hydrogen are precipitated during tempering. Hence, permeation of hydrogen through steel cannot be prevented or cracking cannot be prevented during quenching. Therefore, the content of C is limited to the range of 0.15% to 0.50% and is preferably 0.20% to 0.30%.

Si: 0.1% to 1.0%

Si is an element which acts as a deoxidizing agent, which solve in steel to enhance the strength of the steel, and which has the action of suppressing rapid softening during tempering. The content thereof needs to be 0.1% or more to achieve such effects. However, when the content thereof is more than 1.0%, course oxide inclusions are formed to act as strong trap sites for hydrogen and the amount of a solid solution containing an effective element is reduced. Therefore, the content of Si is limited to the range of 0.1% to 1.0% and is preferably 0.20% to 0.30%.

Mn: 0.3% to 1.0%

Mn is an element which enhances the strength of steel through an increase in hardenability, which combines with S to form MnS, and which has the action of fixing S to prevent intergranular embrittlement due to S. The content thereof needs to be 0.3% or more. However, when the content thereof is more than 1.0%, the coarsening of cementite precipitated at grain boundaries causes a reduction in resistance to sulfide stress cracking. Therefore, the content of Mn is limited to the range of 0.3% to 1.0% and is preferably 0.4% to 0.8%.

P: 0.015% or Less

P tends to segregate at grain boundaries and the like in a solid solution state to cause intergranular cracking and the like. The content thereof is preferably minimized and a P content of up to 0.015% is acceptable. Therefore, the content of P is limited to 0.015% or less and is preferably 0.013% or less.

S: 0.005% or Less

S reduces ductility, toughness, and corrosion resistance including resistance to sulfide stress cracking because most of S in steel is present in the form of sulfide inclusions. A portion thereof may possibly be present in the form of a solid solution. In this case, S tends to segregate at grain boundaries and the like to cause intergranular cracking and the like. The content thereof is preferably minimized. However, excessive reduction thereof causes a significant increase in refining cost. Therefore, the content of S is limited to 0.005% or less because the adversely affect thereof is acceptable.

Al: 0.01% to 0.1%

Al acts as a deoxidizing agent, combines with N to form AN, and contributes to the refining of austenite grains. The content of Al needs to be 0.01% or more to achieve such effects. However, when the content thereof is more than 0.1%, an increase in oxide inclusion causes a reduction in toughness. Therefore, the content of Al is limited to the range of 0.01% to 0.1% and is preferably 0.02% to 0.07%.

N: 0.01% or Less

N combines with nitride-forming (or nitride formation) elements such as Mo, Ti, Nb, and Al to form MN-type precipitates. These precipitates cause a reduction in SSC resistance and reduce the amount of a solid solution of an element such as Mo, effective in enhancing SSC resistance and the amount of MC- and $M_2C$-type precipitates formed during tempering. Hence, desired high strength cannot be expected. Therefore, the content of N is preferably minimized and limited to 0.01% or less. Since the MN-type precipitates have the effect of preventing the coarsening of crystal grains during the heating of steel, the content of N is preferably about 0.003% or more.

Cr: 0.1% to 1.7%

Cr is an element which contributes to the increase in strength of steel through an increase in hardenability and which enhances the corrosion resistance thereof. Cr combines with C during tempering to form an $M_3C$-type carbide, an $M_7C_3$-type carbide, an $M_{23}C_6$-type carbide, and the like. The $M_3C$-type carbide enhances resistance to temper softening, reduces the change in strength due to tempering temperature, and allows the adjustment of strength to be easy. The content thereof needs to be 0.1% or more to achieve such effects. However, when the content thereof is more than 1.7%, large amounts of the $M_7C_3$- and $M_{23}C_6$-type carbides are formed and act as trap sites for hydrogen to cause a reduction in resistance to sulfide stress cracking. Therefore, the content of Cr is limited to the range of 0.1% to 1.7% and is preferably 0.5% to 1.5% and more preferably 0.9% to 1.5%.

Mo: 0.40% to 1.1%

Mo forms a carbide to contribute to an increase in strength due to precipitation hardening, and furthermore Mo solve in steel, and segregates at prior-austenite grain boundaries to contribute the enhancement of resistance to sulfide stress cracking Mo densifies corrosion products to prevent development and growth of pits acting as origins of cracks. The content thereof needs to be 0.40% or more to achieve such effects. However, when the content thereof is more than 1.1%, needle-like $M_2C$-type precipitates are formed and a Laves phase ($Fe_2Mo$) may possibly be formed, leading to a reduction in resistance to sulfide stress cracking. Therefore, the content of Mo is limited to 0.40% to 1.1% and preferably 0.6% to 1.1%. When the content of Mo is within this range, $M_2C$-type precipitates have substantially a particulate shape. The term "substantially a particulate shape" as used herein refers to a spherical or spheroid shape. Since needle-like precipitates are not included herein, precipitates with an aspect ratio (a major-to-minor axis ratio or a maximum-to-minimum diameter ratio) of 5 or less are intended. When precipitates with substantially a particulate shape are connected to each other, the aspect ratio of a cluster of the precipitates is used.

The content of Mo is within the above range and the content of Mo in a solid solution state (solute Mo) is 0.40% or more. When the content of solute Mo is 0.40% or more, a concentrated region (segregation) that preferably has a width of 1 nm to less than 2 nm can be formed at a grain boundary such as a prior-austenite (γ) grain boundary. The micro-segregation of solute Mo at the prior-γ grain boundary strengthens grain boundaries to significantly enhance resistance to sulfide stress cracking. The presence of solute Mo creates a dense corrosion product and prevents development and growth of pits acting as origins of cracks to significantly enhance resistance to sulfide stress cracking. The desired amount of solute Mo can be ensured such that tempering treatment subsequent to quenching treatment is performed at an appropriate temperature in consideration of the amount of Mo consumed in the form of MN-type precipitates. The content of solute Mo is defined as a value obtained by subtracting the content of precipitated Mo from the content of total Mo, the content of precipitated Mo being determined by the quantitative analysis of an electrolytic residue subsequently to tempering treatment.

V: 0.01% to 0.12%

V is an element which forms a carbide or a nitride to contribute to the hardening of steel. The content thereof needs to be 0.01% or more to achieve such an effect. However, when the content thereof is more than 0.12%, such an effect is saturated and therefore advantages appropriate to the content thereof cannot be expected. Therefore, the content of V is limited to the range of 0.01% to 0.12% and is preferably 0.02% to 0.08%.

Nb: 0.01% to 0.08%

Nb is an element which delays recrystallization at austenitic (γ) temperatures to contribute to the refining of γ grains, which extremely effectively acts on the refining of the substructure (for example, packet, block, lath, or the like) of martensite, and which has the action of forming a carbide to harden steel. The content thereof needs to be 0.01% or more to achieve such effects. However, when the content thereof is more than 0.08%, the precipitation of coarse precipitates (NbN) is promoted and a reduction in resistance to sulfide stress cracking is caused. Therefore, the content of Nb is limited to 0.01% to 0.08%, preferably 0.02% to 0.06%. The term "packet" as used herein is defined as a region consisting of a group of laths arranged in parallel and which have the same habit plane and the term "block" as used herein is defined as a region consisting of a group of laths arranged in parallel and which have the same orientation.

B: 0.0005% to 0.003%

B is an element which contributes to an increase in hardenability in a small amount. The content thereof needs to be 0.0005% or more. However, when the content thereof is more than 0.003%, such an effect is saturated or a boride such as Fe—B is formed. Hence, desired advantages cannot be expected, which is economically disadvantageous. Furthermore, when the content thereof is more than 0.003%, the formation of coarse borides such as $Mo_2B$ and $Fe_2B$ is promoted and therefore cracks are likely to be caused during hot rolling. Therefore, the content of B is limited to 0.0005% to 0.003%, preferably 0.001% to 0.003%.

Cu: 0.03% to 1.0%

Cu is an element which enhances the strength of steel, which has the action of enhancing the toughness and corrosion resistance thereof, and which is important particularly in the case where severe resistance to sulfide stress cracking is required and therefore may be added as required. The addition thereof causes a dense corrosion product to be formed and prevents development and growth of pits acting as origins of cracks to significantly enhance resistance to sulfide stress cracking. The content thereof is preferably 0.03% or more. However, when the content thereof is more than 1.0%, such effects are saturated and a significant increase in cost is caused. Therefore, when Cu is contained, the content thereof is preferably 0.03% to 1.0% and more preferably 0.03% to 0.10%.

Those described above are fundamental components. In addition to such fundamental components, one or two selected from the group consisting of 1.0% or less Ni, 0.03% or less Ti, and 2.0% or less W may be contained.

Ni: 1.0% or Less

Ni is an element which enhances the strength of steel and which enhances the toughness and corrosion resistance thereof and therefore may be contained as required. The content of Ni is preferably 0.03% or more to achieve such effects. However, when the content of Ni is more than 1.0%, such effects are saturated and an increase in cost is caused. Therefore, when Ni is contained, the content of Ni is preferably limited to 1.0% or less.

One or Two Selected from 0.03% or Less Ti and 2.0% or Less W

Ti and W are elements which form carbides to contribute to the hardening of steel and therefore may be selectively contained as required.

Ti is an element which forms a carbide or a nitride to contribute to the hardening of steel. The content thereof is preferably 0.01% or more to achieve such an effect. However, when the content thereof is more than 0.03%, the formation of a coarse MC-type nitride (TiN) is promoted during casting to cause a reduction in toughness and a reduction in resistance to sulfide stress cracking because such a nitride does not solve in steel by heating. Therefore, the content of Ti is preferably limited to 0.03% or less and more preferably 0.01% to 0.02%.

W, as well as Mo, forms a carbide to contribute to the hardening of steel by precipitation hardening, forms a solid solution, and segregates at prior-austenite grain boundaries to contribute the enhancement of resistance to sulfide stress cracking. The content thereof is preferably 0.03% or more to achieve such an effect. However, when the content thereof is more than 2.0%, resistance to sulfide stress cracking is reduced. Therefore, the content of W is preferably limited to 2.0% or less and more preferably 0.05% to 0.50%.

Ca: 0.001% to 0.005%

Ca is an element which transforms elongated sulfide inclusions into particulate inclusions, that is, controls the morphology of inclusions and which has the effect of enhancing ductility, toughness, resistance to sulfide stress cracking through the action of controlling the inclusion morphology. Ca may be added as required. Such an effect is remarkable when the content thereof is 0.001% or more. When the content thereof is more than 0.005%, non-metallic inclusions are increased and therefore ductility, toughness, resistance to sulfide stress cracking are reduced. Therefore, when Ca is contained, the content of Ca is limited to 0.001% to 0.005%.

The remainder other than the above components are Fe and unavoidable impurities.

The steel tube has the above composition and a microstructure which has a tempered martensite phase that is a main phase and prior-austenite grain size number is 8.5 or more and 0.06% by mass or more of a dispersed $M_2C$-type precipitate with substantially a particulate shape. The microstructure preferably has Mo-concentrated regions which lie on prior-austenite grain boundaries and which have a width of 1 nm to less than 2 nm.

To ensure a high strength of about 110 ksi (1 ksi=1 klb/in$^2$=6.89 MPa) with relatively low alloying element content without using a large amount of an alloying element, the steel tube has martensite phase microstructures. To ensure desired toughness, ductility, and resistance to sulfide stress cracking, the microstructure contains the tempered martensite phase, which is a main phase and is obtained by tempering these martensite phases. The term "main phase" as used herein refers to a single tempered martensite phase or a microstructure containing a tempered martensite phase and less than 5% of a second phase within a range not affecting properties on a volume basis. When the content of the second phase is 5% or more, properties such as strength, toughness, and ductility are reduced. Thus, the term "microstructure which contains a tempered martensite phase that is a main phase" means a microstructure containing 95% or more of a tempered martensite phase on a volume basis. Examples of the second phase, of which the content is less than 5% by volume, include bainite, pearlite, ferrite, and mixtures of these phases.

In the steel tube, the prior-austenite (γ) grain size number is 8.5 or more. The grain size number of the prior-γ grains is a value determined in accordance with regulations specified in JIS G 0551. When the prior-γ grains have a grain size number of less than 8.5, the substructure of a martensite phase transformed from a γ phase is coarse and desired resistance to sulfide stress cracking cannot be ensured.

Furthermore, in the steel tube, the microstructure contains the dispersed $M_2C$-type precipitate which has the prior-γ grain size number and substantially a particulate shape. The dispersed $M_2C$-type precipitate has substantially a particulate shape. Since the $M_2C$-type precipitate is dispersed, an increase in strength is significant and desired high strength can be ensured without impairing resistance to sulfide stress cracking. When the content of the $M_2C$-type precipitate with needle-like shape is large, resistance to sulfide stress cracking is reduced, that is, desired resistance to sulfide stress cracking cannot be ensured.

0.06% by mass or more of the $M_2C$-type precipitate is dispersed. When the dispersion amount thereof is less than 0.06% by mass, desired high strength cannot be ensured. The content thereof is preferably 0.08% to 0.13% by mass. A desired amount of the $M_2C$-type precipitate can be achieved by optimizing the content of Mo, Cr, Nb, or V or the temperature and time of quenching and tempering.

The content α of solute Mo and the content β of the dispersed $M_2C$-type precipitate are preferably adjusted to satisfy the following inequality:

$$0.7 \leq \alpha + 3\beta \leq 1.2 \quad (1)$$

wherein α is the content (mass percent) of solute Mo and β is the content (mass percent) of the $M_2C$-type precipitate. When the content of solute Mo and the content of the $M_2C$-type precipitate do not satisfy Inequality (1), resistance to sulfide stress cracking is reduced.

Furthermore, the microstructure of the steel tube preferably has the prior-austenite grain size number and the Mo-concentrated regions, which lie on the prior-γ grain boundaries and which have a width of 1 nm to less than 2 nm. The concentration (segregation) of solute Mo on the prior-γ grain boundaries, which are typical embrittled regions, prevents hydrogen coming from surroundings from being trapped on the prior-γ grain boundary to enhance the SSC resistance. The Mo-concentrated regions, which lie on the prior-γ grain boundaries, may have a width of 1 nm to less than 2 nm to achieve such an effect. In addition to the prior-γ grain boundary, solute Mo is preferably concentrated on various crystal defects such as dislocations, packet boundaries, block boundaries, and lath boundaries, likely to trap hydrogen.

Figure 2:
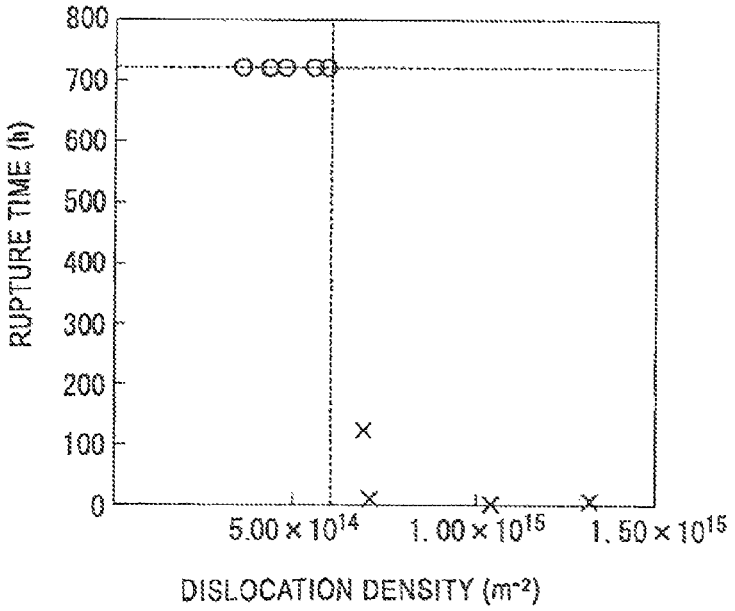
FIG. 2 is a graph showing the relationship between the dislocation density and the rupture time determined by a resistance-to-sulfide stress cracking test.

Furthermore, the microstructure of the steel tube preferably has a dislocation density of $6.0\times10^{14}/m^2$ or less. Dislocations function as trap sites for hydrogen to store a large amount of hydrogen. Therefore, when the dislocation density thereof is high, the SSC resistance is likely to be reduced. FIG. 2 shows the influence of dislocations present in microstructures on SSC resistance in the form of the relationship between the dislocation density and the rupture time determined by a resistance-to-sulfide stress cracking test.

The dislocation density was determined by a procedure below.

After a surface of a specimen (size: a thickness of 1 mm, a width of 10 mm, and a length of 10 mm) taken from each steel tube was mirr(r-polished, strain was removed from a surface layer thereof with hydrofluoric acid. The specimen from which strain was removed was analyzed by X-ray diffraction, whereby the half bandwidth of a peak corresponding to each of the (110) plane, (211) plane, and (220) plane of tempered martensite (b.c.c. crystal structure) was determined. The inhomogeneous strain ϵ of the specimen was determined by the Williamson-Hall method (see Nakashima et al., CAMP-ISIJ. vol. 17 (2004), 396) using these half bandwidths. The dislocation density ρ was determined by the following equation:

$$\rho = 14.4\epsilon^2/b^2$$

wherein b is the Burgers vector (=0,248 nm) of tempered martensite (b.c.c. crystal structure).

The resistance-to-sulfide stress cracking test was performed under conditions below.

A specimen (size: a gauge section diameter of 6.35 mm ϕ and a length of 25.4 mm) taken from each steel tube was immersed in an aqueous solution (a test temperature of 24° C.), saturated with $H_2S$, containing 0.5% (weight percent) of acetic acid and 5.0% (weight percent) of sodium chloride in accordance with regulations specified in NACE TM 0177 Method A. Constant load testing was performed with an applied stress equal to 90% of the yield strength of the steel tube for up to 720 hours, whereby the time taken to rupture the specimen was measured.

FIG. 2 illustrates that a steel tube with a dislocation density of $6.0\times10^{14}/m^2$ or less is not ruptured for 720 hours with an applied stress equal to 90% of the yield strength of the steel tube, that is, good SSC resistance can be ensured.

A desired high strength of about 110 ksi grade can be maintained and the dislocation density can be adjusted to an appropriate range, that is, $6.0\times10^{14}/m^2$ or less by appropriately adjusting the tempering temperature and soaking time of tempering treatment.

A preferred method for manufacturing the steel tube will now be described.

A steel tube material having the above composition is used as a starting material. After being heated to a predetermined temperature, the steel tube material is hot-rolled into a seamless steel tube with a predetermined size. The seamless steel tube is tempered or quenched and then tempered. Furthermore, straightening may be performed as required for the purpose of correcting the improper shape of the steel tube.

The method for producing the steel tube material need not be particularly limited. Molten steel having the above composition is preferably produced in a steel converter, an electric furnace, a vacuum melting furnace, or the like by an ordinary known process and is then cast into the steel tube material such as a billet, by an ordinary process such as a continuous casting process or an ingot casting-blooming process.

The steel tube material is preferably heated to a temperature of 1000° C. to 1350° C. When the heating temperature thereof is lower than 1000° C., dissolution of carbides is insufficient. However, when the heating temperature thereof is higher than 1350° C., crystal grains become excessively coarse. Therefore, cementite on prior-γ grain boundaries becomes coarse, impurity elements such as P and S are significantly concentrated (segregated) on grain boundaries, and the grain boundaries become brittle. Hence, intergranular fracture is likely to occur. The soaking time thereof at the above-mentioned temperature is preferably 4 h or less in view of production efficiency.

The heated steel tube material is preferably hot-rolled by an ordinary process such as the Mannesmann-plug mill process or the Mannesmann-mandrel mill process, whereby the seamless steel tube is manufactured to have a predetermined size. The seamless steel tube may be manufactured by a press process or a hot extrusion process. After being manufactured, the seamless steel tube is preferably cooled to room temperature at a rate not less than that obtained by air cooling. When the microstructure thereof contains 95% by volume or more of martensite, the seamless steel tube need not be quenched by reheating and then rapid cooling (water cooling). The seamless steel tube is preferably quenched by reheating and then rapid cooling (water cooling) to stabilize the quality thereof. When the microstructure thereof does not contain 95% by volume or more of martensite, the hot-rolled seamless steel tube is quenched by reheating and then rapid cooling (water cooling).

The seamless steel tube is quenched such that the seamless steel tube is reheated to the $Ac_3$ transformation temperature thereof, preferably a quenching temperature of 850° C. to 1050° C., and then rapidly cooled (water-cooled) from the quenching temperature to the martensitic transformation temperature or lower, preferably a temperature of 100° C. or lower. This allows a microstructure (a microstructure containing 95% by volume or more of a martensite phase) containing a martensite phase having a fine substructure transformed from a fine γ phase to be obtained. When the heating temperature for quenching is lower than the $Ac_3$ transformation temperature (lower than 850° C.), the seamless steel tube cannot be heated to an austenite single phase zone and therefore a sufficient martensite microstructure cannot be obtained by subsequent cooling. Hence, desired strength cannot be ensured. Therefore, the heating temperature for quenching treatment is preferably limited to the $Ac_3$ transformation temperature or higher.

The seamless steel tube is preferably water-cooled from the heating temperature for quenching to the martensite transformation temperature or lower, preferably a temperature of 100° C. or lower, at a rate of 2° C./s or more. This allows a sufficiently quenched microstructure (a microstructure containing 95% by volume or more of martensite) to be obtained. The soaking time at the quenching temperature is preferably three minutes or more in view of uniform heating.

The quenched seamless steel tube is subsequently tempered.

Tempering treatment is performed for the purpose of reducing excessive dislocations to stabilize the microstructure; promoting precipitation of fine $M_2C$-type precipitates with substantially a particulate shape; segregating solute Mo on crystal defects such as grain boundaries; and achieving desired high strength and excellent resistance to sulfide stress cracking.

The tempering temperature is preferably within the range of 665° C. to 740° C. When the tempering temperature is below the above-mentioned range, the number of hydrogen-trapping sites such as dislocations is increased and therefore resistance to sulfide stress cracking is reduced. In contrast, when the tempering temperature is above the above-mentioned range, the microstructure is significantly softened and therefore desired high strength cannot be ensured. Furthermore, the number of needle-like $M_2C$-type precipitates is increased and therefore resistance to sulfide stress cracking is reduced. The seamless steel tube is preferably tempered such that the seamless steel tube is held at a temperature within the above-mentioned range for 20 minutes or more and is then cooled to room temperature at a rate not less than that obtained by air cooling. The soaking time at the tempering temperature is preferably 100 minutes or less. When the soaking time at the tempering temperature is excessively long, a Laves phase ($Fe_2Mo$) is precipitated and the amount of Mo in substantially a solid solution state is reduced.

The dislocation density is preferably reduced to $6.0\times10^{14}/m^2$ or less by adjusting tempering treatment for the purpose of enhancing resistance to sulfide stress cracking. To reduce the dislocation density to $6.0\times10^{14}/m^2$ or less, the tempering temperature T (° C.) and the soaking time t (minutes) at the tempering temperature are adjusted to satisfy the following inequality:

$$70\ \text{nm} \le 10000000\sqrt{(60Dt)} \le 150\ \text{nm} \quad (2)$$

wherein T is the tempering temperature (° C.), t is the soaking time (minutes), and D ($cm^2/s$)=4.8exp(−(63×4184)/(8.31(273+T)). Herein, D in Inequality (2) is the self-diffusion coefficient of iron atoms in martensite. The value of Inequality (2) denotes the diffusion distance of an iron atom held (tempered) at temperature T for time t.

When the value (the diffusion distance of an iron atom) of Inequality (2) is less than 70 nm, the dislocation density cannot be adjusted to $6.0\times10^{14}/m^2$ or less. However, when the value (the diffusion distance of an iron atom) of Inequality (2) is more than 150 nm, the yield strength YS is less than 110 ksi, which is a target value. Thus, excellent SSC resistance and desired high strength (a YS of 110 ksi or more) can be achieved such that the tempering temperature and soaking time are selected to satisfy the range defined by Inequality (2) and temper treatment is performed.

Our steel tubes and methods are further described below in detail with reference to examples.

EXAMPLES

Steels having compositions shown in Table 1 were each produced in a vacuum melting furnace, were subjected to degassing treatment, and were then cast into steel ingots. The steel ingots (steel tube materials) were heated at 1250° C. (held for 3 h) and were then worked into seamless steel tubes (an outer diameter of 178 mm ϕ and a thickness of 22 mm) with a seamless mill.

Test pieces (steel tubes) were taken from the obtained seamless steel tubes. The test pieces (steel tubes) were quenched and then tempered under conditions shown in Table 2. Since the seamless steel tubes (an outer diameter of 178 mm ϕ and a thickness of 22 mm) which were used here and which were cooled to room temperature at a rate not less than that obtained by air cooling cannot obtain any microstructure containing 95% by volume or more of martensite, all the seamless steel tubes were quenched prior to temper treatment.

Specimens were taken from the obtained test pieces (steel tubes) and were then subjected to a microstructure observation test, a tensile test, a corrosion test, and quantitative analysis tests for determining precipitate content and solute Mo content. Test methods were as described below.

(1) Microstructure Observation Test

Specimens for microstructure observation were taken from the obtained test pieces (steel tubes). A surface of each specimen that was a cross section of the longitudinal direction thereof was polished, was corroded (a corrosive solution such as nital), observed for microstructure with an optical microscope (a magnification of 1000 times) and a scanning electron microscope (a magnification of 2000 times), and then photographed. The type and fraction of a microstructure were determined with an image analyzer.

For the reveal of prior-γ grain boundaries, the specimen was corroded with picral, three fields of view of each microstructure thereby obtained were observed with an optical microscope (a magnification of 400 times), and the grain size number of prior-γ grains by an intercept method in accordance with regulations specified in JIS G 0551.

Precipitates were observed and identified by transmission electron microscopy (TEM) and energy dispersive X-ray spectroscopy (EDS). In particular, a replica extracted from each specimen for microstructure observation was observed at a magnification of 5000 times and precipitates present in a field of view analyzed for composition by EDS. The content of Mo, which is a metal element (M) in precipitates, was less than 10% in terms of atomic concentration, was judged to be an $M_3C$-, $M_7C_3$-, or $M_{23}C_6$-type precipitate and a precipitate having a Mo content of more than 30% was judged to be an $M_2C$-type precipitate. Fifty or more of $M_2C$-type precipitates were evaluated for shape.

Also, the changes in the concentration of an element located at prior-γ grain boundaries were evaluated at thin films prepared by an electropolishing method by a scanning transmission electron microscope (STEM) and EDS. The diameter of an ion beam used was about 0.5 nm. Each thin film was analyzed on 20-nm straight lines sandwiching a prior-γ grain boundary at a pitch of 0.5 nm. From results obtained by determining the EDS spectrum obtained from each spot, the half bandwidth was determined as the width of a Mo-concentrated region at the prior-γ grain boundary. FIG. 1 shows an example of a state in which Mo is concentrated at a prior-γ grain boundary, as a result of line analysis.

Specimens (size: a thickness of 1 mm, a width of 10 mm, and a length of 10 mm) for dislocation density measurement were taken from the obtained test pieces (steel tubes) and measured for dislocation density by a method similar to that described above.

That is, after a surface of each specimen was mirror-polished, strain was removed from a surface layer thereof with hydrofluoric acid. The specimen from which strain was removed was analyzed by X-ray diffraction, whereby the half bandwidth of a peak corresponding to each of the (110) plane, (211) plane, and (220) plane of ft mpered tnartensite (b.c.c. crystal structure) was determined. The inhomogeneous strain $\epsilon$ of the specimen was determined by the Williamson-Hall method (see Nakashima et al.. CAMP-ISLI., vol. 17 (2004), 396) using these half bandwidths. The dislocation density ρ was determined by the following equation:

$$\rho=14.4\epsilon^2/b^2.$$

(2) Tensile test

API strip tensile specimens were taken from the obtained test pieces (steel tubes) in accordance with regulations specified in API 5CT and were then subjected to a tensile test, whereby tensile properties (yield strength YS and tensile strength TS) thereof were determined.

(3) Corrosion Test

Corrosion specimens were taken from the obtained test pieces (steel tubes) and then subjected to constant load testing in an aqueous solution (a test temperature of 24° C.), saturated with $H_2S$, containing 0.5% (weight percent) of acetic acid and 5.0% (weight percent) of sodium chloride in accordance with regulations specified in NACE TM 0177 Method A. After a stress equal to 85%, 90%, or 95% of the yield strength thereof was applied to each specimen for 720 hours, the specimen was checked whether cracks were present, whereby the specimen was evaluated for resistance to sulfide stress cracking A projector with a magnification of ten times was used to observe cracks.

(4) Quantitative Analysis Tests for Determining Precipitate Content and Solute Mo Content Specimens for electrolytic extraction were taken from the obtained test pieces (steel tubes). By using the thus obtained specimens for electrolytic extraction and by adopting an electrolytic extraction method (a 10% AA electrolytic solution) with constant-current electrolysis at a current density of 20 mA/cm$^2$, 0.5 g of the electrolytic residue was obtained. The electrolytic solution containing an extracted electrolytic residue was filtered through a filter with a pore size of 0.2 μm. After filtration, the electrolytic residue remaining on the filter was analyzed by inductively coupled plasma atomic emission spectroscopy, whereby the content of Mo in a precipitate was determined. The content (mass percent) of precipitated Mo in a sample was calculated therefrom. The 10-weight percent AA electrolytic solution is a methanol solution containing 10 weight percent acetyl acetone and 1 weight percent tetramethylammonium chloride. The content (mass percent) of solute Mo was obtained by subtracting the content (mass percent) of precipitated Mo from the content (mass percent) of total Mo.

The dispersion amount of an $M_2C$-type precipitate was calculated from a value obtained by determining each of metal elements, Cr and Mo, in the electrolytic residue by inductively coupled plasma atomic emission spectroscopy. The X-ray diffraction of the electrolytic residue shows that major tempered precipitates are of an $M_3C$ type and an $M_2C$ type. The average composition of $M_3C$-type precipitates and that of $M_2C$-type precipitates determined from results obtained by analyzing precipitates in the extraction replica by energy dispersive X-ray spectroscopy shows that most of precipitated Cr is present in a $M_3C$-type precipitate. Therefore, the content of Mo in the $M_3C$-type precipitate can be calculated from the average composition of the $M_3C$-type precipitates obtained from the EDS analysis results and the value obtained by determining Mo in the electrolytic residue by ICP atomic emission spectroscopy. The content of solute Mo in a $M_2C$-type precipitate was determined from the difference between the value obtained by determining Cr in the electrolytic residue and the content of Mo in the $M_3C$-type precipitate obtained by the above calculation and then converted into the dispersion amount β of the $M_2C$-type precipitate dispersed in the steel tube.

Obtained results are shown in Table 3.

Our Examples all provide steel tubes having desired high strength (a yield strength of 758 MPa or more, that is, 110 ksi or more) and desired resistance to sulfide stress cracking. However, the Comparative Examples cannot ensure desired microstructures or a desired solute Mo content and therefore cannot ensure desired high strength or desired excellent resistance to sulfide stress cracking.

The examples that have tempering conditions satisfying Inequality (2) all have a dislocation density of $6.0\times10^{14}$/m$^2$ or less and such excellent resistance to sulfide stress cracking that rupture does not occur at an applied stress equal to 90% of the yield strength.

In particular, when the content of Cu is within the range of 0.03% to 1.0% as specified herein (Steel Tube No. 6 to 9, 19, and 20), such an unpredictable particular advantage that rupture does not occur at an applied stress equal to 95% of the yield strength in severe corrosive environments is obtained.

TABLE 1

| Steel | Chemical compositions (mass percent) | | | | | | | | | | | | | | | | |
|---|---|---|---|---|---|---|---|---|---|---|---|---|---|---|---|---|---|
| No. | C | Si | Mn | P | S | Al | Cr | Mo | V | Nb | B | Ca | N | Cu | Ni | Ti, W | Remarks |
| A | 0.25 | 0.25 | 1.0 | 0.015 | 0.0020 | 0.040 | 0.50 | 0.01 | — | — | 0.0025 | — | 0.0028 | — | — | Ti: 0.01 | Comparative Example |

TABLE 1-continued

| Steel No. | Chemical compositions (mass percent) C | Si | Mn | P | S | Al | Cr | Mo | V | Nb | B | Ca | N | Cu | Ni | Ti, W | Remarks |
|---|---|---|---|---|---|---|---|---|---|---|---|---|---|---|---|---|---|
| B | 0.25 | 0.25 | 0.6 | 0.010 | 0.0007 | 0.025 | 1.0 | 0.99 | 0.03 | 0.03 | 0.0020 | 0.002 | 0.0040 | — | — | Ti: 0.02 | Example |
| C | 0.26 | 0.27 | 0.5 | 0.008 | 0.0010 | 0.050 | 1.0 | 0.70 | 0.04 | 0.03 | 0.0022 | 0.002 | 0.0031 | — | — | — | Example |
| D | 0.25 | 0.27 | 0.6 | 0.010 | 0.0007 | 0.028 | 1.3 | 0.80 | 0.03 | 0.05 | 0.0021 | 0.002 | 0.0027 | 0.1 | 0.05 | Ti: 0.02 | Example |
| E | 0.24 | 0.26 | 0.6 | 0.011 | 0.0007 | 0.027 | 1.0 | 0.80 | 0.07 | 0.05 | 0.0021 | 0.002 | 0.0022 | 0.05 | — | Ti: 0.02 | Example |
| F | 0.25 | 0.26 | 0.6 | 0.011 | 0.0007 | 0.027 | 1.0 | 0.80 | 0.03 | 0.05 | 0.0021 | 0.002 | 0.0030 | — | — | Ti: 0.02, W: 0.3 | Example |
| G | 0.24 | 0.26 | 0.5 | 0.008 | 0.0014 | 0.034 | 1.0 | 0.27 | — | 0.03 | 0.0021 | 0.002 | 0.0030 | — | — | Ti: 0.01 | Comparative Example |
| H | 0.25 | 0.25 | 1.0 | 0.015 | 0.0020 | 0.040 | 1.5 | 1.00 | 0.03 | 0.03 | 0.0025 | — | 0.0050 | — | — | Ti: 0.02 | Example |
| I | 0.26 | 0.26 | 0.6 | 0.010 | 0.0007 | 0.029 | 1.3 | 0.79 | 0.07 | 0.05 | 0.0017 | 0.003 | 0.0033 | 0.05 | — | Ti: 0.02 | Example |
| J | 0.25 | 0.25 | 0.6 | 0.010 | 0.0007 | 0.027 | 1.3 | 0.81 | 0.03 | 0.05 | 0.0020 | 0.002 | 0.0031 | 0.05 | — | Ti: 0.02 | Example |
| K | 0.24 | 0.26 | 0.5 | 0.008 | 0.0013 | 0.033 | 1.1 | 0.37 | 0.02 | 0.03 | 0.0020 | 0.002 | 0.0031 | — | — | Ti: 0.02 | Comparative Example |
| L | 0.26 | 0.25 | 0.6 | 0.010 | 0.0007 | 0.027 | 1.3 | 0.81 | — | 0.05 | 0.0020 | 0.002 | 0.0039 | — | — | Ti: 0.02 | Comparative Example |
| M | 0.27 | 0.27 | 0.4 | 0.006 | 0.0013 | 0.072 | 0.7 | 0.70 | 0.05 | — | 0.0023 | 0.002 | 0.0035 | — | — | Ti: 0.02 | Comparative Example |

TABLE 2

| | | Heat treatment conditions | | | | Adaptation of | | |
|---|---|---|---|---|---|---|---|---|
| | | Quenching treatment | | Tempering treatment | | Inequality (2) | | |
| Steel Tube No. | Steel No. | Quenching temperature (° C.) | Soaking time (minutes) | Tempering temperature (° C.) | Soaking time (minutes) | Value of Inequality (2)* | Adaptation | Remarks |
| 1 | A | 920 | 5 | 675 | 20 | 41 | Not adapted | Comparative Example |
| 2 | B | 920 | 5 | 700 | 30 | 77 | Adapted | Example |
| 3 | B | 920 | 5 | 720 | 30 | 108 | Adapted | Example |
| 4 | C | 920 | 5 | 690 | 30 | 65 | Not adapted | Example |
| 5 | C | 920 | 5 | 690 | 30 | 65 | Not adapted | Example |
| 6 | D | 920 | 5 | 700 | 30 | 77 | Adapted | Example |
| 7 | D | 920 | 5 | 720 | 30 | 108 | Adapted | Example |
| 8 | E | 920 | 5 | 740 | 30 | 147 | Adapted | Example |
| 9 | E | 920 | 5 | 715 | 30 | 99 | Adapted | Example |
| 10 | F | 920 | 5 | 700 | 30 | 77 | Adapted | Example |
| 11 | G | 920 | 5 | 690 | 20 | 53 | Not adapted | Comparative Example |
| 12 | D | 890 | 5 | 625 | 80 | 32 | Not adapted | Comparative Example |
| 13 | D | 1100 | 10 | 685 | 80 | 98 | Adapted | Comparative Example |
| 14 | D | 890 | 5 | 660 | 80 | 63 | Not adapted | Comparative Example |
| 15 | D | 890 | 5 | 685 | 80 | 98 | Adapted | Example |
| 16 | D | 890 | 5 | 710 | 80 | 149 | Adapted | Example |
| 17 | H | 920 | 5 | 680 | 30 | 55 | Not adapted | Example |
| 18 | H | 920 | 5 | 700 | 30 | 77 | Adapted | Example |
| 19 | I | 910 | 5 | 685 | 80 | 98 | Adapted | Example |
| 20 | J | 890 | 5 | 685 | 80 | 98 | Adapted | Example |
| 21 | K | 920 | 5 | 675 | 60 | 71 | Adapted | Comparative Example |
| 22 | L | 890 | 5 | 675 | 80 | 82 | Adapted | Comparative Example |
| 23 | M | 920 | 5 | 690 | 30 | 65 | Not adapted | Comparative Example |

*The value of Inequality (2) is given by 10000000 √(60 Dt).

TABLE 3

| Steel Tube No. | Steel No. | Content α of solute Mo (mass percent) | Microstructure: Grain size number of prior-γ grains | Microstructure: Fraction of second phase (volume percent) Type* | Microstructure: M2C-type precipitate Shape | Microstructure: M2C-type precipitate Dispersion amount β (mass percent) | Inequality (1)** α + 3β | Inequality (1)** Adaptation |
|---|---|---|---|---|---|---|---|---|
| 1 | A | 0 | 8.0 | TM + B 1.0 | — | 0.00 | 0.00 | Not adapted |
| 2 | B | 0.51 | 11.0 | TM + B 1.0 | Spherical | 0.12 | 0.86 | Adapted |
| 3 | B | 0.47 | 11.0 | TM + B 1.0 | Spherical | 0.12 | 0.83 | Adapted |
| 4 | C | 0.54 | 10.0 | TM + B 1.0 | Spherical | 0.09 | 0.81 | Adapted |
| 5 | C | 0.53 | 10.0 | TM + B 1.0 | Spherical | 0.07 | 0.75 | Adapted |
| 6 | D | 0.59 | 11.0 | TM + B 1.0 | Spherical | 0.10 | 0.90 | Adapted |
| 7 | D | 0.59 | 11.0 | TM + B 1.0 | Spherical | 0.10 | 0.90 | Adapted |
| 8 | E | 0.6 | 11.0 | TM + B 1.0 | Spherical | 0.13 | 0.99 | Adapted |
| 9 | E | 0.58 | 11.0 | TM + B 1.0 | Spherical | 0.13 | 0.97 | Adapted |
| 10 | F | 0.52 | 11.0 | TM + B 1.0 | Spherical | 0.11 | 0.85 | Adapted |
| 11 | G | 0.2 | 11.0 | TM + B 1.0 | Spherical | 0.05 | 0.34 | Not adapted |
| 12 | D | 0.59 | 11.0 | TM + B 1.0 | — | 0.00 | 0.59 | Not adapted |
| 13 | D | 0.54 | 8.0 | TM + B 1.0 | Spherical | 0.08 | 0.78 | Adapted |
| 14 | D | 0.56 | 11.0 | TM + B 1.0 | Spherical | 0.08 | 0.80 | Adapted |
| 15 | D | 0 51 | 11.0 | TM + B 1.0 | Spherical | 0.18 | 1.05 | Adapted |
| 16 | D | 0.51 | 11.0 | TM + B 1.0 | Spherical | 0.12 | 0.87 | Adapted |
| 17 | H | 0.6 | 11.0 | TM + B 1.0 | Spherical | 0.13 | 0.99 | Adapted |
| 18 | H | 0.6 | 11.0 | TM + B 1.0 | Spherical | 0.15 | 1.05 | Adapted |
| 19 | I | 0.55 | 11.0 | TM + B 1.0 | Spherical | 0.08 | 0.79 | Adapted |
| 20 | J | 0.55 | 11.0 | TM + B 1.0 | Spherical | 0.08 | 0.79 | Adapted |
| 21 | K | 0.27 | 11.0 | TM + B 1.0 | Spherical | 0.06 | 0.44 | Not adapted |
| 22 | L | 0.49 | 11.0 | TM + B 1.0 | Spherical | 0.06 | 0.67 | Not adapted |
| 23 | M | 0.48 | 8.0 | TM + B 1.0 | Spherical | 0.09 | 0.75 | Adapted |

| Steel Tube No. | Width of Mo-concentrated region at grain boundary (nm) | Tensile properties YS (MPa) | Tensile properties TS (MPa) | Dislocation density $(m^{-2}) \times 10^{14}$ | SSC resistance Cracks Load *** 85% | SSC resistance Cracks Load *** 90% | SSC resistance Cracks Load *** 95% | Remarks |
|---|---|---|---|---|---|---|---|---|
| 1 | — | 658 | 765 | 3.0 | Present | Present | Present | Comparative Example |
| 2 | 1.0 | 817 | 903 | 4.7 | Not present | Not present | Present | Example |
| 3 | 1.0 | 760 | 846 | 3.5 | Not present | Not present | Present | Example |
| 4 | 1.5 | 894 | 938 | 8.0 | Not present | Present | Present | Example |
| 5 | 1.0 | 902 | 936 | 8.8 | Not present | Present | Present | Example |
| 6 | 1.5 | 828 | 913 | 5.5 | Not present | Not present | Not present | Example |
| 7 | 1.8 | 777 | 868 | 4.3 | Not present | Not present | Not present | Example |
| 8 | 1.8 | 761 | 819 | 4.0 | Not present | Not present | Not present | Example |
| 9 | 1.5 | 817 | 893 | 4.6 | Not present | Not present | Not present | Example |
| 10 | 1.0 | 834 | 915 | 5.4 | Not present | Not present | Present | Example |
| 11 | 0.5 | 707 | 800 | 3.3 | Present | Present | Present | Comparative Example |
| 12 | 1.5 | 995 | 1075 | 16.0 | Present | Present | Present | Comparative Example |
| 13 | 1.5 | 770 | 878 | 5.0 | Present | Present | Present | Comparative Example |

TABLE 3-continued

| | | | | | | | | |
|---|---|---|---|---|---|---|---|---|
| 14 | 1.0 | 886 | 968 | 7.1 | Present | Present | Present | Comparative Example |
| 15 | 1.5 | 858 | 949 | 5.5 | Not present | Not present | Present | Example |
| 16 | 1.8 | 774 | 865 | 4.7 | Not present | Not present | Present | Example |
| 17 | 1.0 | 858 | 957 | 7.5 | Not present | Present | Present | Example |
| 18 | 1.0 | 803 | 904 | 4.5 | Not present | Present | Present | Example |
| 19 | 1.4 | 794 | 881 | 4.4 | Not present | Not present | Not present | Example |
| 20 | 1.4 | 832 | 917 | 5.5 | Not present | Not present | Not present | Example |
| 21 | 0.7 | 724 | 816 | 3.5 | Present | Present | Present | Comparative Example |
| 22 | 1.0 | 849 | 939 | 6.3 | Present | Present | Present | Comparative Example |
| 23 | 1.0 | 883 | 928 | 7.2 | Present | Present | Present | Comparative Example |

*TM is tempered martensite, F is ferrite, B is bainite, and P is pearlite.

**$0.7 \leq \alpha + 3\beta \leq 1.2$

***The term "Load 85%" refers to an applied load equal to 85% of the yield strength, the term "Load 90%" refers to an applied load equal to 90% of the yield strength, and term "Load 95%" refers to an applied load equal to 95% of the yield strength.

The invention claimed is:

1. A seamless steel tube for oil wells, containing 0.15% to 0.50% C, 0.1% to 1.0% Si, 0.3% to 1.0% Mn, 0.015% or less P, 0.005% or less S, 0.01% to 0.1% Al, 0.01% or less N, 0.1% to 1.7% Cr, 0.81% to 1.1% Mo, 0.01% to 0.12% V, 0.01% to 0.08% Nb, 0.0005% to 0.003% B, 0.05% or less Ni, and 0.03% to 0.10% Cu on a mass basis, the remainder being Fe and unavoidable impurities, and having a microstructure comprising a tempered martensite phase that is a main phase, prior-austenite grains with a grain size number of 8.5 or more and 0.06% by mass or more of a dispersed $M_2C$ precipitate with substantially a particulate shape and Mo-concentrated regions located at boundaries between the prior-austenite grains and which have a width of 1 nm to less than 2 nm, wherein the content of solute Mo is 0.40% or more on a mass basis and content a of solute Mo and content β of the $M_2C$ precipitate with substantially a particulate shape, satisfy inequality (1):

$$0.7 \leq \alpha + 3\beta \leq 1.2 \quad (1)$$

where α is the content (mass percent) of solute Mo and β is the content (mass percent) of the $M_2C$ precipitate.

2. The seamless steel tube according to claim 1, wherein the microstructure has a dislocation density of $6.0 \times 10^{14}/m^2$ or less.

3. The seamless steel tube according to claim 1, further comprising one or both of 0.03% or less Ti and 2.0% or less W on a mass basis.

4. The seamless steel tube according to claim 1, further comprising 0.001% to 0.005% Ca on a mass basis.

5. A method of manufacturing a seamless steel tube for oil wells comprising:

reheating a steel tube material containing 0.15% to 0.50% C, 0.1% to 1.0% Si, 0.3% to 1.0% Mn, 0.015% or less P, 0.005% or less S, 0.01% to 0.1% Al, 0.01% or less N, 0.1% to 1.7% Cr, 0.81% to 1.1% Mo, 0.01% to 0.12% V, 0.01% to 0.08% Nb, 0.0005% to 0.003% B, 0.05% or less Ni, and 0.03% to 0.10% Cu on a mass basis, the remainder being Fe and unavoidable impurities, to a temperature of 1000° C. to 1350° C.;

hot-rolling the steel tube material into a seamless steel tube having a selected shape;

cooling the seamless steel tube to room temperature at a rate not less than that obtained by air cooling; and tempering the seamless steel tube at a temperature of 665° C. to 740° C. such that the steel tube has a microstructure comprising Mo-concentrated regions located at boundaries between the prior-austenite grains and which have a width of 1 nm to less than 2 nm and content α of solute Mo and content β of $M_2C$ precipitate with substantially a particulate shape, satisfy inequality (1):

$$0.7 \leq \alpha + 3\beta \leq 1.2 \quad (1)$$

where α is the content (mass percent) of solute Mo and β is the content (mass percent) of the $M_2C$ precipitate.

6. The method according to claim 5, further comprising a quenching treatment including reheating and rapid cooling performed prior to the tempering.

7. The method according to claim 6, wherein the quenching temperature of the quenching treatment is the $Ac_3$ transformation temperature to 1050° C.

8. The method according to claim 5, wherein the tempering treatment is performed such that the tempering temperature T (° C.) is within the temperature range and the relationship between the tempering temperature T ranging from 665° C. to 740° C. and a soaking time t (minutes) satisfies inequality (2):

$$70\ \text{nm} \leq 10000000\sqrt{(60Dt)} \leq 150\ \text{nm} \quad (2)$$

where T is tempering temperature (° C.), t is soaking time (minutes), and D $(cm^2/s) = 4.8\exp(-(63 \times 4184)/(8.31(273+T))$.

9. The method according to claim 5, wherein the composition further comprises one or both of 0.03% or less Ti and 2.0% or less W on a mass basis.

10. The method according to claim 5, wherein the composition further comprises 0.001% to 0.005% Ca on a mass basis.

* * * * *

UNITED STATES PATENT AND TRADEMARK OFFICE

CERTIFICATE OF CORRECTION

PATENT NO. : 9,234,254 B2
APPLICATION NO. : 13/379723
DATED : January 12, 2016
INVENTOR(S) : Eguchi et al.

It is certified that error appears in the above-identified patent and that said Letters Patent is hereby corrected as shown below:

In the Specification

In column 6

At line 35, please change "cracking" to -- cracking. --.

Signed and Sealed this
Sixteenth Day of August, 2016

Michelle K. Lee

Michelle K. Lee
*Director of the United States Patent and Trademark Office*